US010576771B2

(12) United States Patent
Torisaka et al.

(10) Patent No.: US 10,576,771 B2
(45) Date of Patent: Mar. 3, 2020

(54) INK JET RECORDING METHOD AND INK JET RECORDING APPARATUS

(71) Applicant: CANON KABUSHIKI KAISHA, Tokyo (JP)

(72) Inventors: Yoshitaka Torisaka, Tokyo (JP); Shinichi Sakurada, Gainesville, FL (US); Takashi Imai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/019,905

(22) Filed: Jun. 27, 2018

(65) Prior Publication Data

US 2019/0009602 A1 Jan. 10, 2019

(30) Foreign Application Priority Data

Jul. 4, 2017 (JP) ..... 2017-131066
Jun. 11, 2018 (JP) ..... 2018-111479

(51) Int. Cl.
*B41J 2/005* (2006.01)
*B41M 5/00* (2006.01)
(Continued)

(52) U.S. Cl.
CPC ..... *B41M 5/0017* (2013.01); *B41J 2/0057* (2013.01); *B41J 2/01* (2013.01); *B41J 11/0015* (2013.01)

(58) Field of Classification Search
CPC ..... B41M 5/0017; B41J 2/01; B41J 2/0057; B41J 11/0015; B41J 2/2114
See application file for complete search history.

(56) References Cited

U.S. PATENT DOCUMENTS 8,042,906 B2 10/2011 Chiwata et al.
9,656,459 B2 5/2017 Kuwabara et al.
(Continued)

FOREIGN PATENT DOCUMENTS

EP 2 042 325 A2 4/2009
EP 3 115 209 A2 1/2017
(Continued)

OTHER PUBLICATIONS

Ohnishi et al., U.S. Appl. No. 16/022,223, filed Jun. 28, 2018.
(Continued)

*Primary Examiner* — Henok D Legesse
(74) *Attorney, Agent, or Firm* — Venable LLP

(57) ABSTRACT

Provided is an ink jet recording method capable of suppressing movement of a coloring material and adhesion thereof to a porous layer even after repeated contact of the porous layer with a first image.

This method of recording an image on a recording medium by using an aqueous reaction liquid and a water-based ink containing a first ink includes applying a reaction liquid containing a reactant and resin particles to the entirety of a first recording medium; applying a coloring material-containing first ink to the first recording medium to form a first image; and bringing a porous layer of a liquid absorption member into contact with the first image to absorb a liquid component from a first-image-including portion on the first recording medium. The volume-based cumulative pore size (μm) at 10% of the porous layer is greater than the volume-based cumulative particle size (μm) at 90% of the resin particles.

11 Claims, 2 Drawing Sheets

(51) Int. Cl.
*B41J 11/00* (2006.01)
*B41J 2/01* (2006.01)

(56) References Cited

U.S. PATENT DOCUMENTS

| | | | | |
|---|---|---|---|---|
| 10,029,481 | B2 | 7/2018 | Ohnishi et al. | |
| 2006/0164487 | A1 | 7/2006 | Kadomatsu et al. | |
| 2006/0170752 | A1 | 8/2006 | Kadomatsu et al. | |
| 2008/0074462 | A1* | 3/2008 | Hirakawa | B41J 2/0057 347/28 |
| 2014/0192112 | A1* | 7/2014 | Nagashima | B41M 7/00 347/21 |
| 2018/0297377 | A1 | 10/2018 | Ohnishi et al. | |
| 2018/0304616 | A1 | 10/2018 | Honda et al. | |
| 2018/0304617 | A1 | 10/2018 | Ohnishi et al. | |
| 2018/0319166 | A1 | 11/2018 | Yamane et al. | |
| 2018/0319188 | A1 | 11/2018 | Toyama et al. | |
| 2018/0319189 | A1 | 11/2018 | Ohnishi et al. | |

FOREIGN PATENT DOCUMENTS

| | | | | |
|---|---|---|---|---|
| JP | 2009-96175 | A | 5/2009 | |
| JP | 2017-024365 | A | 2/2017 | |
| JP | 2017024365 | * | 2/2017 | B41J 2/01 |
| WO | 2017/119044 | A1 | 7/2017 | |
| WO | 2017/119045 | A1 | 7/2017 | |
| WO | 2017/119046 | A1 | 7/2017 | |
| WO | 2017/119047 | A1 | 7/2017 | |
| WO | 2017/119049 | A1 | 7/2017 | |

OTHER PUBLICATIONS

Toyama et al., U.S. Appl. No. 16/022,118, filed Jun. 28, 2018.
Yamane et al., U.S. Appl. No. 16/022,143, filed Jun. 28, 2018.
Honda et al., U.S. Appl. No. 16/022,169, filed Jun. 28, 2018.
Ohnishi et al., U.S. Appl. No. 16/022,189, filed Jun. 28, 2018.
Ohnishi et al., U.S. Appl. No. 16/013,276, filed Jun. 20, 2018.
Ohnishi et al., U.S. Appl. No. 16/018,182, filed Jun. 27, 2018.
U.S. Appl. No. 16/022,223, WO 2017/119046 A1.
U.S. Appl. No. 16/022,118, WO 2017/119044 A1.
U.S. Appl. No. 16/022,143, WO 2017/119045 A1.
U.S. Appl. No. 16/022,169, WO 2017/119047 A1.
U.S. Appl. No. 16/022,189, WO 2017/119049 A1.
Extended European Search Report in European Application No. 18181346.0 (dated Nov. 23, 2018).

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

As an ink to be used in an ink jet recording method, a water-based ink has been used popularly. In order to immediately remove the liquid component in an ink, there is a method of drying a recording medium with warm air, infrared ray, or the like and then recording an image thereon. There is also a method of forming, as an intermediate image, a first image on a transfer body with a water-based ink, removing the liquid component contained in the first image by thermal energy or the like, and then transferring the resulting first image to a recording medium to record an image. An ink jet recording method using a transfer body is under investigation (refer to Japanese Patent Application Laid-Open No. 2009-96175). This ink jet recording method includes a step of applying a reaction liquid containing a reactant and resin particles and then, an ink to a transfer body to form a first image and a step of bringing a porous body into contact with the first image to remove the liquid component from the first image.

SUMMARY OF THE INVENTION

As the result of investigation by the present inventors, it has been found that when many images are recorded using the ink jet recording method described in Japanese Patent Application Laid-Open No. 2009-96175, a coloring material in the first image may move and adhere to the porous body.

An object of the present invention is therefore to provide an ink jet recording method capable of, even after recording of many images, suppressing movement of a coloring material and at the same time, suppressing adhesion of the coloring material to a porous layer. Another object of the invention is to provide an ink jet recording apparatus using the above-described ink jet recording method.

The above-described object can be achieved by the invention described below. The invention relates to an ink jet recording method of recording an image on a recording medium by making use of an aqueous reaction liquid and a water-based ink containing a first ink. This method includes a reaction liquid applying step, that is, a step of applying a reaction liquid containing a reactant and resin particles to a first recording medium, an image formation step, that is, a step of applying a first ink containing a coloring material to the first recording medium to form a first image and a liquid absorption step, that is, a step of bringing a porous layer possessed by a liquid absorption member into contact with the first image to absorb a liquid component from a portion including the first image on the first recording medium. In this ink jet recording method, a volume-based cumulative pore size (μm) at 10% of the porous layer is greater than a volume-based cumulative particle size (μm) at 90% of the resin particles.

The invention also relates to an ink jet recording apparatus including a unit of applying a first ink to a first recording medium after applying a reaction liquid thereto and a unit of bringing a porous layer possessed by a liquid absorption member into contact with a portion including a first image formed with the reaction liquid and the first ink on the first recording medium. In this ink jet recording apparatus, the reaction liquid is an aqueous reaction liquid containing a reactant and resin particles, the first ink is a water-based ink containing a coloring material, and a volume-based cumulative pore size (μm) at 10% of the porous layer is greater than a volume-based cumulative particle size (μm) at 90% of the resin particles.

According to the invention, an ink jet recording method and an ink jet recording apparatus capable of, even after recording of many images, suppressing movement of a coloring material and adhesion of the coloring material to a porous layer.

Further features of the present invention will become apparent from the following description of exemplary embodiments with reference to the attached drawings.

DESCRIPTION OF THE EMBODIMENTS

Figure 1:
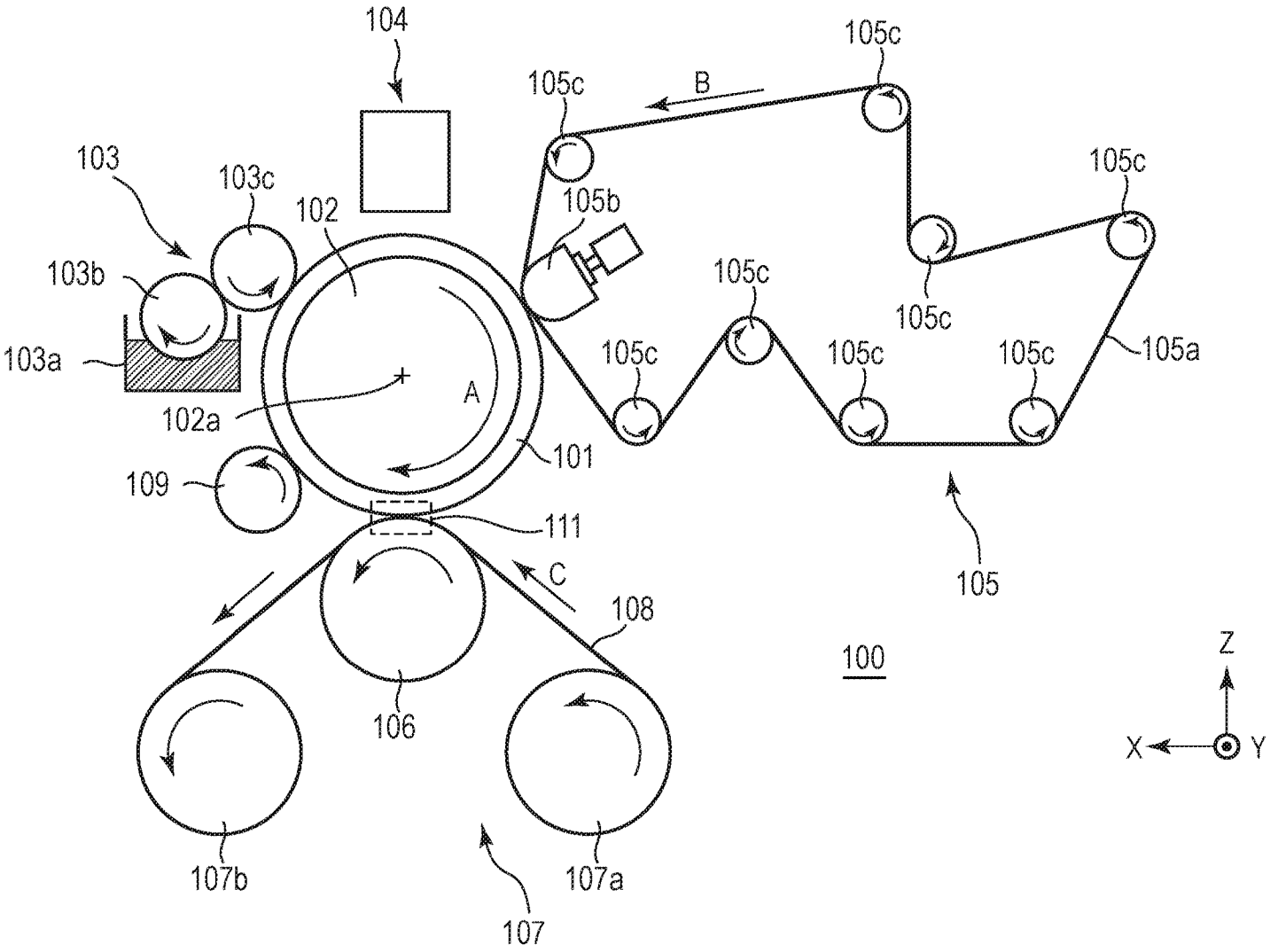
FIG. 1 is a schematic view showing one example of a transfer type ink jet recording apparatus to be used in the ink jet recording method of the invention.

Preferred embodiments of the present invention will now be described in detail in accordance with the accompanying drawings.

Embodiments of the invention will hereinafter be described in detail. In the invention, the terms "water-based ink" and "first ink" may be called "ink" and the term "aqueous reaction liquid" may be called "reaction liquid". Values of various physical properties are at 25° C. unless otherwise particularly specified. The terms "(meth)acrylic acid" and "(meth)acrylate" mean "acrylic acid and methacrylic acid" and "acrylate and methacrylate", respectively.

In the ink jet recording method of the invention, an aqueous reaction liquid and a water-based ink containing a first ink are utilized. When after application of a reaction liquid containing resin particles to a first recording medium, a first ink containing a coloring material is applied to the first recording medium, presence of the resin particles hinders movement of the coloring material in the first ink from a position to which the coloring material has been applied. Then, even when the porous layer possessed by the liquid absorption member comes into contact with a portion including a first image formed with the reaction liquid and the first ink on the first recording medium, the coloring material in the first image easily remains at the position to which the coloring material has been applied and movement of the coloring material in the first image is hindered. In particular, contact of the porous layer to the first image easily causes movement of the coloring material in directions around the first image, but movement of the coloring material in directions around the first image can be suppressed by the presence of the resin particles.

The first recording medium to which the reaction liquid has been applied has a portion having no ink thereon and in this portion, the reaction liquid exists without a reaction with the ink. The porous layer therefore comes into contact with a portion containing the first image on the first recording medium, more specifically, with not only the first image but also the portion having the reaction liquid that has not reacted with the ink. Since the reaction liquid that has not reacted with the ink has a liquid component and in addition, non-aggregated resin particles, not only the liquid component in the reaction liquid but also the resin particles are absorbed in the porous layer brought into contact with the reaction liquid. In particular, recording of many images leads to repetitive contact not only between the porous layer and the first image but also between the porous layer and the reaction liquid so that when the porous layer has a pore size smaller than the particle size of the resin particles in the reaction liquid, the pores of the porous layer are easily clogged with the resin particles. Even contact of the porous layer having pores clogged with the resin particles with the first image makes it difficult to accelerate aggregation of the coloring material in the first image because of difficulty in absorbing the liquid component from the first image. When many images are recorded and contact of the porous layer with the reaction liquid is repeated, movement of the coloring material together with the liquid component contained in the first image inevitably occurs in spite of the presence of the resin particles. Movement of the coloring material to directions around the first image cannot be suppressed. Further, acceleration of aggregation of the coloring material in the first image is hindered, making it also impossible to suppress adhesion of the coloring material to the porous layer.

Considering that in order to suppress movement of the coloring material and adhesion of the coloring material to the porous layer, a volume-based cumulative pore size at 10% of the porous layer should be made greater than a volume-based cumulative particle size at 90% of the resin particles, the present inventors have completed the invention. The volume-based cumulative pore size at 10% of the porous layer and the volume-based cumulative particle size at 90% of the resin particles may hereinafter be briefly called "pore size of the porous layer" and "particle size of the resin particles", respectively. The pore size of the porous layer is determined using a pore size distribution analyzer based on a gas permeation method or the like. The particle size of the resin particles is determined using a dynamic light scattering method or the like.

The term "cumulative pore size at 10%" means a pore diameter when in a pore size cumulative curve, pore sizes are accumulated from a small pore size side and they reach 10% of the total volume of the pores measured. The volume of the pores means the volume of penetrating pores. The term "cumulative particle size at 90%" means a particle diameter when in a particle size cumulative curve, particle sizes are accumulated from a small particle size side and they reach 90% of the total volume of the resin particles measured. The sentence "volume-based cumulative pore size at 10% of the porous layer is greater than the volume-based cumulative particle size at 90% of the resin particles" means that almost all the pore sizes of the porous layer are greater than the particle size of the resin particles. When many images are recorded and contact of the porous layer with the reaction liquid is repeated, resin particles are absorbed together with the liquid component in the reaction liquid so that the pores of the porous layer are not easily clogged with the resin particles. Even if the porous layer used in repetition is brought into contact with the first image, aggregation of the coloring material in the first image is accelerated because the liquid component is absorbed smoothly from the first image. By this, movement of the coloring material can be suppressed. Further, aggregation of the coloring material in the first image is accelerated so that adhesion of the coloring material to the porous layer can be suppressed.

The ink jet recording method of the invention, even using either of the following method (1) or (2), can suppress both movement of the coloring material and adhesion of the coloring material to the porous layer.

(1) A method of transferring a first image, which has been formed by applying an ink to a first recording medium, to a recording medium to record an image.

(2) A method of applying an ink directly to a recording medium to record an image.

In the case of (1), the first recording medium is a transfer body and this ink jet recording method preferably has, after a liquid absorption step, a transfer step, that is, a step of transferring the first image on the transfer body to the recording medium. Ink jet recording apparatuses usable in the methods (1) and (2), respectively, will next be described. For the convenience sake, an ink jet recording apparatus usable in the method (1) will be called "transfer type ink jet recording apparatus", while that usable in the method (2) will be called "direct recording type ink jet recording apparatus".

<Transfer Type Ink Jet Recording Apparatus>

FIG. 1 is a schematic view showing one example of a transfer type ink jet recording apparatus to be used in the ink jet recording method of the invention. The first recording medium when the transfer type ink jet recording apparatus is used is a transfer body.

A transfer type ink jet recording apparatus 100 is a sheet feed type ink jet recording apparatus which manufactures a recorded product by transferring a first image to a sheet-shaped recording medium 108 via a transfer body 101. Directions X, Y and Z mean a width direction (entire length direction), depth direction and height direction, respectively, of the transfer type ink jet recording apparatus 100. The recording medium is conveyed in the direction X.

The transfer type ink jet recording apparatus 100 has, as shown in FIG. 1, the transfer body 101 supported by a support member 102 and a reaction liquid applying unit 103 for applying a reaction liquid to the transfer body 101. It further has an ink applying unit 104 equipped with a recording head for applying an ink to the transfer body 101 to which the reaction liquid has been applied and forming a first image, a liquid absorption unit 105 for absorbing a liquid component from a portion including the first image and a pressing member 106 for transferring the first image to the recording medium 108. The recording head ejects an ink through an ink jet system. The transfer type ink jet recording apparatus 100 may have a transfer body cleaning member 109 for cleaning the surface of the transfer body 101 after transfer. The transfer body 101, the reaction liquid applying unit 103, the recording head possessed by the ink applying unit 104, the liquid absorption unit 105 and the transfer body cleaning member 109 each have, in the direction Y, a length corresponding to the recording medium 108 used.

The transfer body 101 rotates in the direction of the arrow A with a rotation axis 102*a* of the support member 102 as a center. The transfer body 101 rotates with the rotation of this support member 102. A reaction liquid is applied from the reaction liquid applying unit 103 to this rotating transfer body 101. Then, an ink is applied from the ink applying unit 104 to a region of the transfer body 101 to which the reaction liquid has been applied. In such a manner, a first image is formed on the transfer body 101. By the rotation of the transfer body 101, the first image formed on the transfer body 101 moves to a position where it comes into contact with a liquid absorption member 105*a* possessed by the liquid absorption unit 105.

The liquid absorption member 105*a* rotates in synchronization with the rotation of the transfer body 101. The first image formed on the transfer body 101 comes into contact with the rotating liquid absorption member 105*a*. During this contact state, the liquid absorption member 105*a* absorbs a liquid component from the first image. From the standpoint of efficient absorption of the liquid component, the liquid absorption member 105*a* is preferably pressed by the transfer body 101 at a certain pressing force.

Since the first image is formed using the reaction liquid and the first ink, the term "absorption of a liquid component in the ink" means absorption of the liquid component in the reaction liquid and the first ink. By the absorption of the liquid component, the liquid component is removed from the first image so that absorption of the liquid component is, in other words, concentration of the ink. Concentration of the ink decreases the liquid component in the ink and thereby increases a ratio of a solid component such as coloring material and resin in the ink to the liquid component.

The first image in which the ink is concentrated as a result of absorption of the liquid component moves to a region where it comes into contact with the recording medium 108 by the rotation of the transfer body 101. The first image and the recording medium 108 are brought into contact with each other by being pressed from the side of the pressing member 106 while being sandwiched between the transfer body 101 and the pressing member 106. When a roller type transfer body 101 and a columnar pressing member 106 are used, the first image and the recording medium 108 come into linear contact along the direction Y. At this time, when the transfer body 101 is comprised of a material having elasticity, the transfer body 101 is dented by pressing force and the first image and the recording medium 108 come into surface contact. The contact point or contact surface between the first image and the recording medium 108 is regarded as a "region" and a portion containing this region is designated as a "transfer unit 111". During contact of the liquid component-absorbed first image with the recording medium 108, the pressing member 106 presses the transfer body 101 to transfer the first image to the recording medium 108. A second image transferred to the recording medium 108 is a reversed image of the first image formed on the transfer body 101. The term "second image" as used herein means a final image and the term "first image" means an image other than the final image. Formation of the final image may be followed by thermal fixing or lamination.

The liquid component contained in the ink or the reaction liquid has fluidity and almost a constant volume without having a particular shape. More specifically, an aqueous medium or the like which is a component contained in the ink or reaction liquid is a liquid component.

Next, main units constituting the transfer type ink jet recording apparatus such as [1] transfer body, [2] support member, [3] reaction liquid applying unit, [4] ink applying unit, [5] liquid absorption unit, [6] pressing member for transfer, [7] recording medium and [8] recording medium conveying unit will be described.

[1] Transfer Body 101

The transfer body 101 has a surface layer as a first image formation surface. Examples of a material constituting the surface layer include resins and ceramics. From the standpoint of durability, materials having a high compressive elastic modulus are preferred. It may be subjected to surface treatment to have improved wettability with the reaction liquid, transferability and the like. The surface layer of it may have any shape.

The transfer body has preferably a compression layer having a function of absorbing pressure variation between the surface layer and the support member. The compression layer absorbs deformation of the surface layer of the transfer body and disperses local pressure variation if any so that the transfer body provided with the compression layer can maintain good transferability even during high-speed recording. Examples of a material constituting the compression layer include materials having elasticity such as rubber materials. Among them, rubber materials obtained by mixing a foaming agent, hollow fine particles and a filler such as salt together with a vulcanizing agent and a vulcanizing accelerator and formed as a porous body are preferred. When pressure variation occurs, a void portion is compressed with a volume change so that deformation of such materials in a direction other than a compressing direction is small and they can have improved transferability and durability. Examples of the rubber materials formed as a porous body include those having a continuous void structure having voids connected to each other and those having an independent void structure having voids independent of each other.

The transfer body preferably has an elastic layer between the surface layer and the compression layer. Examples of a material constituting the elastic layer include resin materials and ceramic materials. Among them, due to easy processability, a small change in elastic modulus due to temperature and excellent transferability, materials having elasticity such rubber materials are preferably used.

Layers constituting the transfer body (surface layer, elastic layer, compression layer) can be bonded to one another using an adhesive or double-sided tape. In order to suppress transverse elongation and keep resilience at the time of installing the transfer body in the apparatus, a reinforcing layer having a high compressive modulus may be provided. As the reinforcing layer, a woven fabric or the like can be used. The transfer body can be manufactured using, not to mention of the surface layer, the elastic layer and the compression layer in any combination.

The size of the transfer body can be selected freely depending on a recording rate or image size. Examples of the shape of the transfer body include sheet shape, roller shape, belt shape and endless web shape. Of these, a sheet-shaped, roller-shaped, or endless web-shaped transfer body is preferred.

[2] Support Member 102

The transfer body 101 is supported by the support member 102. For the support of the transfer body, an adhesive or double-sided tape can be used. Alternatively, a fixing member comprised of a material such as metal, ceramic or resin is attached to the transfer body and with this fixing member, the transfer body may be fixed to the support member 102.

The support member 102 is required to have certain structural strength from the standpoint of conveyance accuracy and durability. Examples of a material constituting the support member include metal materials, ceramic materials and resin materials. Of these, metal materials such as aluminum are preferably used in view of rigidity enough to withstand the stress at the time of transfer, size accuracy and also reduction of the inertia during operation to improve the control responsivity.

[3] Reaction Liquid Applying Unit 103

The ink jet recording method of the invention has a reaction liquid applying step for applying the reaction liquid to the first recording medium prior to the image formation step. When the reaction liquid is brought into contact with an ink, the reactant in the liquid can aggregate an anionic group-containing component (resin, self-dispersible pigment, or the like) in the ink. After application of the first ink, the reaction liquid may be applied further so as to overlap at least partially with a region to which the first ink has been applied.

The transfer type ink jet recording apparatus has a reaction liquid applying unit 103 for applying the reaction liquid to the transfer body 101. In FIG. 1, shown as the reaction liquid applying unit 103 is a gravure offset roller having a reaction liquid storage unit 103*a* for storing therein the reaction liquid and reaction liquid applying members 103*b* and 103*c* for applying the reaction liquid in the reaction liquid storage unit 103*a* to the transfer body 101.

The reaction liquid applying unit is only required to be able to apply the reaction liquid to the transfer body and examples thereof include a gravure offset roller and an ink jet system recording head. Particularly, the reaction liquid is preferably applied to the transfer body with a roller. Application of the reaction liquid to the transfer body with a roller means that the transfer body to which the reaction liquid has been applied has an ink unapplied portion and at this portion, the reaction liquid is present without reacting with the ink. The reaction liquid ejected from a recording head or the like is unlikely to be applied uniformly to the transfer body. The transfer body therefore inevitably has a region where the coloring material in the ink easily aggregates and a region where the coloring material in the ink does not easily aggregate. In the region where the coloring material easily aggregates, an image is recognized as a dense one and in the region where the coloring material does not easily aggregate, an image is recognized as a thin one. Even the second recording image also has a portion recognized as a dense image and a portion recognized as a thin image so that variation in concentration of an image cannot always be suppressed sufficiently.

[4] Ink Applying Unit 104

The transfer type ink jet recording apparatus has an ink applying unit 104 for applying an ink to the transfer body 101.

The ink applying unit preferably ejects an ink from an ink jet system recording head and applies the ink to a recording medium. Examples of an ink ejection system include application of dynamic energy to an ink and application of thermal energy to an ink. Of these, an ink ejection system which applies thermal energy to an ink is preferred.

The recording head is a line type one arranged along the direction Y and has ejection orifices of an ink arranged over the entire region in the width direction of the recording medium. The recording head has an ejection orifice surface with ejection orifice rows and a space between the ejection orifice surface and the transfer body 101 facing therewith can be set at about several mm.

The ink applying unit 104 may have a plurality of recording heads in order to apply first inks of various colors such as cyan, magenta, yellow and black (CMYK) to the transfer body. For example, when a first image is formed using first inks of four colors CMYK, the ink applying unit has four recording heads for ejecting the first inks of four colors CMYK and they are arranged in the direction X.

[5] Liquid Absorption Unit 105

The liquid absorption unit 105 has a liquid absorption member 105*a* and a pressing member 105*b* for liquid absorption for pressing the liquid absorption member 105*a* against the first image of the transfer body 101. The liquid absorption member 105*a* and the pressing member 105*b* can have the following shapes, respectively. Examples include a constitution in which as shown in FIG. 1, the pressing member 105*b* has a columnar shape and the liquid absorption member 105*a* has a belt-like shape and the columnar pressing member 105*b* presses the belt-like liquid absorption member 105*a* against the transfer body 101 and a constitution in which the pressing member 105*b* has a columnar shape, the liquid absorption member 105*a* is attached to the surface around the columnar pressing member 105*b* and the liquid absorption member 105*a* possessed by the pressing member 105*b* is pressed against the transfer body. The liquid absorption member 105*a* has preferably a belt-like shape in consideration of a space in the ink jet recording apparatus. The liquid absorption unit 105 having the belt-like liquid absorption member 105*a* may have an extending member for extending the liquid absorption member 105*a*. A member indicated by 105*c* is an extending roller as the extending member. The pressing member 105*b* is also shown as a roller in FIG. 1 like the extending roller, but the pressing member is not limited to it.

The liquid absorption unit 105 causes the liquid absorption member 105*a* having a porous layer to absorb therein the liquid component contained in the first image by bringing the liquid absorption member 105*a* into contact with the first image by means of the pressing member 105*b*. As a method of causing absorption of the liquid component contained in the first image, as well as the present method of bringing the liquid absorption member into contact with the first image, a method by heating, a method by sending low-humidity air, and a method of reducing pressure may be used in combination. In addition, these methods may be applied to the first image before or after absorption of the liquid component to cause further absorption of the liquid component.

[Liquid Absorption Member]

Through contact with the first image, the porous layer possessed by the liquid absorption member 105*a* absorbs at least a portion of the liquid component from the first image. Such a liquid absorption member having a porous layer rotates in conjunction with rotation of the transfer body 101. The liquid absorption member therefore has preferably a shape permitting repetitive liquid absorption and examples include an endless belt-like shape and a drum-like shape. After a certain region of the liquid absorption member having such a shape comes into contact with the first image and absorbs the liquid component therefrom, the liquid absorption member rotates in a direction of the arrow B and this region moves from the position of the first image. Until the liquid absorption member continues rotating and this region comes into contact with a new first image, the liquid component absorbed from the previous first image and therefore contained in the porous layer is preferably removed from the porous member. The liquid component contained in the porous member can be removed by a method of absorbing it from the back surface of the porous member, a method of making use of a member squeezing the porous member, or the like. The liquid component is removed in such a manner so that when the certain region of the porous member comes into contact with a new first image, it can efficiently absorb the liquid component contained in this first image again.

[Porous Layer]

In the ink jet recording method of the invention, the pore size of the porous layer should be made greater than the particle size of the resin particles. When the pore size of the porous layer is smaller than the particle size of the resin particles and many images are recorded to cause repetitive contact between the porous layer and the reaction liquid, neither movement of the coloring material nor adhesion of the coloring material to the porous layer can be suppressed. Further, with adhesion of the coloring material to the porous layer, the coloring material is separated from the first image that comes into contact with the porous layer and the first image becomes partially colorless. As a result, density unevenness of the image cannot always be suppressed sufficiently.

A ratio of the volume-based cumulative pore size (μm) at 10% of the porous layer to the volume-based cumulative particle size at 90% of the resin particles is preferably 2.2 times or more. When it is 2.2 times or more and a difference between the pore size of the porous layer and the particle size of the resin particles is large, the liquid component contained in the first image is absorbed smoothly and aggregation of the coloring material in the first image is accelerated even when many images are recorded and contact between the porous layer and the reaction liquid is repeated. The movement of the coloring material and the adhesion of the coloring material to the porous layer can therefore be suppressed effectively. Further, the coloring material hardly adheres to the porous layer so that the density unevenness of the image can be suppressed more effectively.

The volume-based cumulative pore size at 10% of the porous layer is preferably 0.10 μm or more to 1.00 μm or less. When the pore size is less than 0.10 μm, pores of the porous layer are small so that they do not absorb the resin particles in the pores and the pores are unlikely to be clogged therewith even when many images are recorded and contact between the porous layer and the reaction mixture is repeated. Since the pores are small, however, they obviously cannot absorb the liquid component from the first image and the liquid component contained in the first image remains therein. The coloring material in the first image does not easily aggregate so that the porous layer brought into contact with the first image after repeated use cannot always suppress the movement of the coloring material sufficiently. When the coloring material in the first image does not aggregate easily, adhesion of the coloring material to the porous layer cannot always be suppressed sufficiently. Further, with the adhesion of the coloring material to the porous layer, the coloring material is separated from the first image that comes into contact with the porous layer and density unevenness of the image cannot always be suppressed sufficiently. When the pore size exceeds 1.00 μm, on the other hand, the pores of the porous layer are large so that capillary force for smooth absorption of the liquid component from the first image does not work and the liquid component contained in the first image easily remains. By the same reason, when the porous layer used in repetition is brought into contact with the first image, movement of the coloring material, adhesion of the coloring material to the porous layer, and density unevenness of the image cannot always be suppressed sufficiently.

Further, to achieve uniformly high air permeability, the porous layer is preferably thin. The air permeability can be expressed as a Gurley value specified by JIS P8117. The Gurley value is preferably 10 seconds or less. The Gurley value is preferably 1 second or more. Thinning of a porous body, however, leads to a decrease in the total void volume of the porous layer so that the maximum amount of the liquid component absorbed by the porous layer decreases, sometimes making it impossible to sufficiently absorb the liquid component contained in the first image. To achieve sufficient absorption of the liquid component contained in the first image, a porous body comprised of, in addition to the porous layer, some layers having a void greater than that of the porous layer can be used. The liquid absorption member is only required to have a porous layer as a layer to be brought into contact with the first image and a layer not brought into contact with the first layer is not necessarily a porous layer.

The porous body will next be described with a porous layer to be brought into contact with the first image as a first layer and a layer stacked on a surface of the first layer on a side opposite to the first image as a second layer. When it is made of a multilayer, the constitution of the multilayer will also be indicated successively in stacking order, starting with the first layer. In the present specification, the first layer may be called "absorption layer" and the second layer and layers subsequent thereto may be called "support layers".

<First Layer>

As a material constituting the first layer, either of a hydrophilic material having a contact angle with water of less than 90° or a water repellent material having a contact angle of 90° or more may be used. Examples of the hydrophilic material include fiber materials such as cellulose and resin material such as polyacrylamide resin and they may be used either singly or in combination. A water repellent material as described later may be used after hydrophilic treatment is given to its surface. Examples of the hydrophilic treatment include sputter etching, exposure to radiation or $H_2O$ ion, and exposure to excimer (ultraviolet) laser light.

When the hydrophilic material is used, it is preferably a hydrophilic material having a contact angle with water of 60° or less. The hydrophilic material has action of sucking up a liquid component, particularly water by its capillary force. From the viewpoint of suppressing adhesion of the coloring material to the first layer or enhancing the cleaning property, a water repellent resin or the like having low surface free energy is preferably used as a material of the first layer. Particularly, the first layer preferably contains a fluorine-based resin. Examples of the fluorine-based resin include polytetrafluoroethylene, polyvinylidene fluoride, polyvinyl fluoride, and polychlorotrifluoroethylene. The fluorine-based resin is particularly preferably polytetrafluoroethylene or polyvinylidene fluoride. Compared with olefin resins such as polypropylene and polyester-based resins such as polyethylene terephthalate, fluorine-based resins have low surface free energy and higher water repellency so that adhesion of the coloring material to the first layer can be suppressed more effectively. Further, difficulty in the adhesion of the coloring material to the first layer hinders separation of the coloring material from the first image that comes into contact with the first layer so that they can suppress density unevenness of an image more effectively.

When the water repellent material is used, on the other hand, action of sucking up the liquid component through capillary force hardly occurs different from the hydrophilic material so that it may take time for the water repellent material to suck up the liquid component. The first layer is therefore preferably impregnated with a treatment liquid having a contact angle with the first layer of less than 90°. The first layer can be impregnated with this treatment liquid by applying the liquid from the surface of the liquid absorption member to be brought into contact with an ink before the porous layer possessed by the liquid absorption member is brought into contact with the first image. The treatment liquid preferably contains water and a water soluble organic solvent. The water is preferably deionized water. As the water soluble organic solvent, an alcohol such as ethanol or isopropyl alcohol can be used. Alternatively, the treatment liquid may be prepared by mixing them with a component such as surfactant. Examples of a method of applying the treatment liquid include immersion and dropwise addition.

The first layer has preferably a thickness of 400 μm or less, more preferably 1 μm or more to 350 μm or less. The thickness of the first layer can be determined by measuring thickness at any 10 points with a micrometer and then calculating an average thereof. More specifically, a digimatic straight formula outside micrometer ("OMV-25MX", product name of Mitsutoyo Corporation) or the like can be used.

The first layer can be formed by a known method of forming a thin porous film. For example, it can be formed by extruding a resin material into a sheet and then stretching the resulting sheet into a predetermined thickness. It can also be formed as a porous film by adding a plasticizer such as paraffin to the material used in extrusion and then removing the plasticizer by heating or the like at the time of stretching. The pore size can be controlled by adjusting the addition amount of the plasticizer, a percent of stretch, or the like as needed.

<Second Layer>

The second layer preferably has air permeability. More specifically, it is nonwoven fabric, woven fabric or the like. Examples of a material constituting the second layer include materials having a contact angle with a second ink equal to or lower than that of the first layer to prevent the backflow of the liquid absorbed in the first layer. Specific examples include resin materials such as olefin resins and urethane resins. The pore size of the second layer is preferably larger than that of the first layer.

<Third Layer>

The porous layer may be comprised of three or more layers. As the third layer or layers subsequent thereto, use of nonwoven fabric is preferred from the standpoint of rigidity. Examples of a material constituting the third layer are similar to those of the second layer.

<Other Members>

The liquid absorption member may have, in addition to the porous body having the above-described stacked structure, a reinforcing member for reinforcing the side surface of the liquid absorption member. When a belt-shaped porous body is formed by connecting the sheet-shaped porous bodies at the longitudinal-direction ends thereof, a joining member such as tape made of a non-porous material may be used. The joining member may be placed preferably at a position not in contact with the first image or placed at regular intervals.

<Manufacturing Method of Porous Body>

As a method of manufacturing the porous body having a stacked structure, two or more layers may only be overlapped with each other or they may be bonded with an adhesive or heat. From the standpoint of air permeability, not bonding with an adhesive but bonding of a plurality of layers with heat is preferred. They may be bonded by heating to melt a portion of the layers or may be bonded to each other by interposing a fusing material such as hot melt powder between the layers and then heating. When three or more layers are stacked one after another, they may be stacked simultaneously or successively. In the latter case, the stacking order can be determined as needed. When heating is necessary for bonding two or more layers, they may be bonded while applying a pressure to the porous body with a heated roller. Various conditions and constitution in the liquid absorption unit 105 will next be described in detail.

<Pressure Applying Conditions>

When the pressure of the liquid absorption member to be brought into contact with the first image of the transfer body is 2.9 N/cm$^2$ (0.3 kg/cm$^2$) or more, solid-liquid separation of the liquid component contained in the first image can be achieved in a shorter time and the liquid component contained in the first image can be removed efficiently. The pressure of the liquid absorption member is a nip pressure between the transfer body and the liquid absorption member. It can be determined, for example, by measuring the surface pressure by means of a pressure distribution measurement system and dividing the load in a pressure applied region by an area. More specifically, a surface pressure distribution measurement system ("I-SCAN", product name of Nitta Corporation) or the like can be used.

<Contact Time>

Contact time for bringing the porous layer possessed by the liquid absorption member 105*a* into contact with the first image is preferably 50 msec or less in order to suppress adhesion of the coloring material to the porous layer as much as possible. The contact time can be determined by dividing the pressure detection width in the movement direction of the transfer body in the above-described surface pressure measurement by the movement speed of the transfer body.

[6] Pressing Member 106 for Transfer

After the liquid component is absorbed from the first image, the resulting first image is transferred to the recording medium 108 at the transfer unit 111. The constitution of the apparatus and conditions at the time of transfer will next be described.

By using the pressing member 106 for transfer, the first image is brought into contact with the recording medium 108, the first image is transferred to the recording medium and a second image is finally recorded. Since the first image from which the liquid component has been adsorbed is transferred to the recording medium, curling, cockling or the like can be suppressed effectively.

The pressing member 106 is required to have a certain degree of structural strength from the standpoint of conveyance accuracy or durability of the recording medium 108. Examples of a material constituting the pressing member 106 include metal materials, ceramic materials, and resin materials. Of these, metal materials such as aluminum are preferably used in view of rigidity enough to withstand the stress at the time of transfer, size accuracy and also reduction of the inertia during operation to improve the control responsivity. Alternatively, the above-described materials may be used in combination.

The time (pressing time) of pressing the transfer body with the pressing member 106 for transferring the first image to the recording medium 108 is preferably 5 msec or more to 100 msec or less from the standpoint of smooth transfer and suppression of the damage of the transfer body. The term "pressing time" means the time during which the recording medium 108 and the transfer body 101 are in contact. The pressing time can be determined by measuring the surface pressure by means of a pressure distribution measurement system and dividing the conveyance-direction length of the pressed region by a conveyance speed. More specifically, a surface pressure distribution measurement system ("I-SCAN", product name of Nitta Corporation) or the like can be used.

The pressure of pressing (pressing force) the transfer body 101 with the pressing member 106 for transferring the first image to the recording medium 108 is preferably a pressure under which transfer is performed smoothly and at the same time, damage of the transfer body is suppressed. The pressure is therefore preferably 9.8 N/cm$^2$ (1 kg/cm$^2$) or more to 294.2 N/cm$^2$ (30 kg/cm$^2$) or less. The term "pressing force" means a nip pressure between the recording medium 108 and the transfer body 101. The pressing force can be determined by measuring the surface pressure by means of a pressure distribution measurement system and dividing a load in the pressed region by an area. More specifically, a surface pressure distribution measurement system ("I-SCAN", product name of Nitta Corporation) or the like can be used.

The temperature at the time when the pressing member 106 presses the transfer body 101 for transferring the first image to the recording medium 108 is preferably the glass transition point or more or the softening point or more, each of the resin component contained in the first image. Depending on the properties of the resin component, however, a heating unit for heating the first image of the transfer body 101, the transfer body 101, and the recording medium 108 is preferably provided for temperature adjustment. Examples of the shape of the pressing member 106 include a roller shape.

[7] Recording Medium 108

Examples of the recording medium 108 include a sheet which may be wound into a roll and a sheet cut into a predetermined size. Examples of a material constituting the recording medium 108 include films made of paper, plastics or a metal, wood boards and corrugated boards.

[8] Recording Medium Conveyance Unit 107

The recording medium conveyance unit 107 for conveying the recording medium in the direction of the arrow C may be any unit insofar as it can convey the recording medium and as shown in FIG. 1, it can be comprised of a recording medium delivery roller 107*a* and a recording medium winding roller 107*b*. The conveyance speed of the recording medium 108 is preferably determined in consideration of the speed required in each step.

<Direct Recording Type Ink Jet Recording Apparatus>

Figure 2:
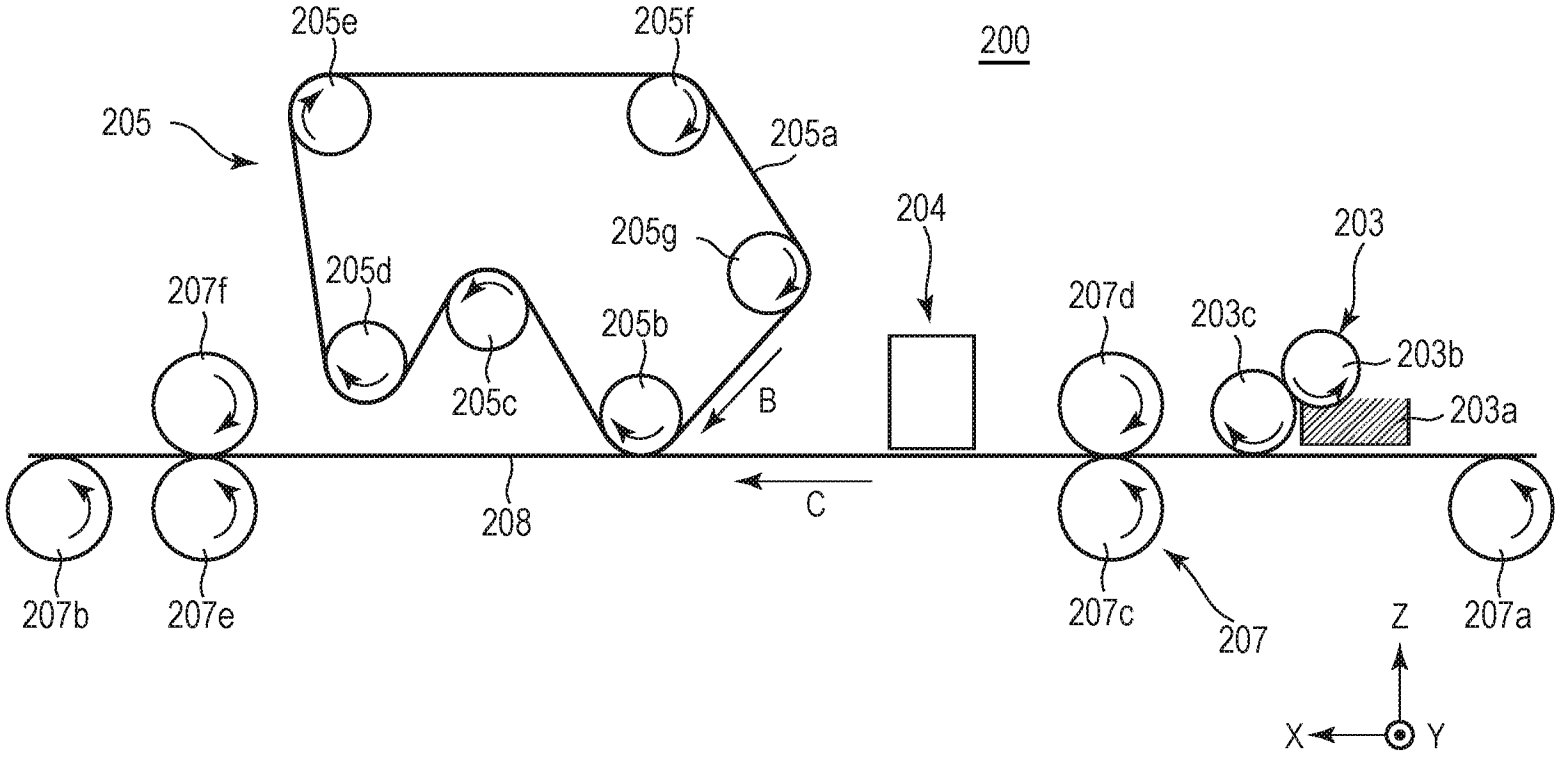
FIG. 2 is a schematic view showing one example of a direct recording type ink jet recording apparatus to be used in the ink jet recording method of the invention.

FIG. 2 is a schematic view showing one example of a direct recording type ink jet recording apparatus to be used in the ink jet recording method of the invention. A first recording medium used in the direct recording type ink jet recording apparatus 200 is not a transfer body but a generally used recording medium. When used in the transfer type apparatus, it is a "recording medium onto which a first image is transferred". Different from the above-described transfer type ink jet recording apparatus, the direct recording type ink jet recording apparatus has none of the transfer body 101, the support member 102, the pressing member 106 for transfer and the transfer body cleaning member 109. It forms a first image on a recording medium 208 and finally records a second image. Units and members other than those described above such as a reaction liquid applying unit 203, an ink applying unit 204, a liquid absorption unit 205 for absorbing a liquid component contained in the first image by means of a liquid absorption member 205*a* and the recording medium 208 can each have a constitution similar to that of the transfer type ink jet recording apparatus.

In FIG. 2, shown as the reaction liquid applying unit 203 is a gravure offset roller having a reaction liquid storage unit 203*a* for storing therein the reaction liquid and reaction liquid applying members 203*b* and 203*c* for applying the reaction liquid in the reaction liquid storage unit 203*a* to the recording medium 208. The liquid absorption unit 205 has the liquid absorption member 205*a* rotating in the direction of the arrow B and a pressing member 205*b* for liquid absorption for pressing the liquid absorption member 205*a* against the first image of the recording medium 208. The shapes of the liquid absorption member 205*a* and the pressing member 205*b* are similar to those of the transfer type, respectively. The liquid absorption unit 205 may have an extending member for extending the liquid absorption member. In FIG. 2, extending rollers as the extending member are indicated by 205*c*, 205*d*, 205*e*, 205*f* and 205*g*, respectively. The number of the extending rollers is not limited to five as shown in FIG. 2 and the required number of them may be placed according to the constitution or size of the unit. The ink applying unit for applying an ink to the recording medium 208 by means of the ink applying unit 204 and the liquid absorption unit for bringing the liquid absorption member 205*a* into contact with the first image of the recording medium to absorb the liquid component therefrom may be provided with a recording medium support member, not shown in the drawing, for supporting the recording medium from the back surface thereof. Examples of the recording medium conveyance unit 207 for conveying the recording medium 208 in the direction of the arrow C have a recording medium delivery roller 207*a*, a recording medium winding roller 207*b* and recording medium conveyance rollers 207*c*, 207*d*, 207*e* and 207*f* as shown in FIG. 2.

<Reaction Liquid>

Components constituting the reaction liquid to be used in the invention will next be described in detail. The content (mass %) of the coloring material in the reaction liquid is preferably 0.1 mass % or less based on the total mass of the reaction liquid, with 0.0 mass % being more preferred. The reaction liquid preferably contains no coloring material.

(Reactant)

The reaction liquid serves to aggregate anionic group-containing components (resin, self-dispersible pigment, and the like) in the ink through the contact with the ink and it contains a reactant.

Examples of the reactant include multivalent metal ions, cationic components such as cationic resin and organic acids. Of these, organic acids are preferred as the reactant.

Examples of the multivalent metal ions include divalent metal ions such as $Ca^{2+}$, $Cu^{2+}$, $Ni^{2+}$, $Mg^{2+}$, $Sr^{2+}$, $Ba^{2+}$ and $Zn^{2+}$ andtrivalent metal ions such as $Fe^{3+}$, $Cr^{3+}$, $Y^{3+}$ and $Al^{3+}$. In order to incorporate the multivalent metal ion in the reaction liquid, a multivalent metal salt (which may be a hydrate) obtained by bonding between the multivalent metal ion and an anion can be used. Examples of the anion include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$ and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When the multivalent metal ion is used as the reactant, the content (mass %) of it in the reaction liquid in terms of a multivalent metal salt is preferably 1.0 mass % or more to 20.0 mass % or less based on the total mass of the reaction liquid.

The reaction liquid containing an organic acid has buffering capacity in an acid region (less than pH 7.0, preferably from pH 0.5 to 5.0) so that it converts the anionic group of the component present in the ink into an acid form and causes aggregation. Examples of the organic acid include monocarboxylic acids such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid and coumaric acid and salts thereof; dicarboxylic acids such as oxalic acid, malonic acid, succinic acid, glutaric acid, adipic acid, maleic acid, fumaric acid, itaconic acid, sebacic acid, phthalic acid, malic acid and tartaric acid and salts or hydrogen salts thereof; tricarboxylic acids such as citric acid and trimellitic acid and salts or hydrogen salts thereof; and tetracarboxylic acids such as pyromellitic acid and salts or hydrogen salts thereof. Of these, the organic acid is preferably at least one of the dicarboxylic acids and salts or hydrogen salts thereof and the tricarboxylic acids and salts or hydrogen salts thereof. The content (mass %) of the organic acid in the reaction liquid is preferably 1.0 mass % or more to 50.0 mass % or less based on the total mass of the reaction liquid.

Examples of the cationic resin include resins having a primary to tertiary amine structure and resins having a quaternary ammonium salt structure. Specific examples include resins having a structure of vinylamine, allylamine, vinylimidazole, vinylpyridine, dimethylaminoethyl methacrylate, ethyleneimine or guanidine. The cationic resin may be used in combination with an acid compound or may be subjected to quaternization treatment to enhance its solubility in the reaction liquid. When the cationic resin is used as the reactant, the content (mass %) of the cationic resin in the reaction liquid is preferably 1.0 mass % or more to 40.0 mass % or less, more preferably 1.0 mass % or more to 10.0 mass % or less, each based on the total mass of the reaction liquid.

(Resin Particles)

By applying a first ink to the first recording medium to which a resin particle-containing reaction liquid has been applied, the coloring material in the first ink is likely to remain at a position where it has been applied due to presence of the resin particles. It is important that the reaction liquid contains resin particles, because even when the porous layer used in repetition is brought into contact with the first image, presence of the resin particles suppresses movement of the coloring material in the first image. As the resin particles, wax particles are preferably used to improve abrasion resistance of the image thus obtained.

The term "wax" means an ester between a fatty acid and a water insoluble higher monohydric or dihydric alcohol according to Encyclopaedia Chimica (ed. by Encyclopaedia Chimica editing committee, published by Kyoritsu Shuppan Co., Ltd.). In the technical fields of an inkjet ink, however, also compounds other than esters and having a smooth solid form at room temperature are usually embraced in this definition. Particularly, wax particles are more preferably polyolefin wax particles. Examples of the polyolefin include polymers of an α-olefin such as ethylene, propylene, 1-butene, 1-pentene, or 1-hexene. Examples of the polyolefin wax include polyolefin oxide wax, high-density polyolefin wax, a mixture of polyolefin oxide wax and paraffin wax, and a polyolefin-acryl copolymer. Of these, polyethylene wax particles are preferred as the polyolefin wax particles, with polyethylene oxide wax particles obtained by oxidizing polyethylene wax particles being more preferred.

The resin particles have preferably a volume-based cumulative particle size (μm) at 90% of 0.03 μm or more to 0.30 μm or less. When the particle size is less than 0.03 μm, the particle size of the resin particles is small. Even when the resin particles are present, application of a first ink containing the coloring material to the first recording material to which the reaction liquid has been applied, the coloring material in the first ink is likely to move from the position to which it has been applied. When the porous layer comes into contact with the first image, the coloring material in the first image does not easily remain at the position where it has been applied so that movement of the coloring material cannot easily be suppressed sufficiently. When the particle size exceeds 0.30 μm, on the other hand, light reflected from the resin particles becomes strong due to the large particle size of the resin particles. This reflected light is white-color light and a portion of the second image recorded where the resin particles are present tends to be recognized colorless and the density unevenness of the image cannot always be suppressed fully.

The content (mass %) of the resin particles in the reaction liquid is preferably 1.0 mass % or more to 25.0 mass % or less, more preferably 2.0 mass % or more to 20.0 mass % or less. The amount ($g/m^2$) of the polyolefin wax particles applied per unit area of the recording medium is preferably 0.04 $g/m^2$ or more to 0.15 $g/m^2$. A ratio of the amount of the polyolefin wax particles applied per unit area of the recording medium to the amount ($g/m^2$) of the coloring material applied per unit area of the recording medium is preferably 0.01 times or more, more preferably 0.08 times or more. When the ratio is less than 0.08 times, meaning that the ratio of the polyolefin wax particles to the coloring material is not enough, the coloring material in the first image hardly remains at a position where it is applied even if the porous layer comes into contact with the first image. This allows easy movement of the coloring material in the first image and the movement of the coloring material to a direction around the first image cannot always be suppressed sufficiently. The above-described ratio is more preferably 0.30 times or less. The ratio can be adjusted by the content of the polyolefin wax particles in the reaction liquid or application amount of the reaction liquid.

(Surfactant)

The reaction liquid preferably contains a surfactant. As the surfactant, at least one of a fluorine-based surfactant and a silicone-based surfactant is preferably used. The content (mass %) of the surfactant in the reaction liquid is preferably 0.1 mass % or more to 10.0 mass % or less, more preferably 2.0 mass % or more to 8.0 mass % or less, each based on the total mass of the reaction liquid.

First, a fluorine-based surfactant will be described in detail. A fluorine-based surfactant represented by $C_xF_{2x+1}$—$(CH_2)_y$—$(OCH_2CH_2)_Z$—OH can be used preferably. In this formula, $C_xF_{2x+1}$ represents a perfluoroalkyl group; x that defines the number of carbon atoms and fluorine atoms of the perfluoroalkyl group is preferably 4 or more to 6 or less; y represents the number of alkylene groups and is preferably 1 or more to 6 or less; and z represents the number of ethylene oxide groups and is preferably 1 or more to 50 or less, more preferably 1 or more to 20 or less, further more preferably 1 or more to 10 or less, particularly preferably 4 or more to 6 or less.

Examples of the fluorine-based surfactant include Surflon S-242, S-243, and S-420 (each, product name of AGC Seimi Chemical); Megaface F-444 (product name of DIC Corporation); and Zonyl FS-300, FSN, FSO-100 and FS-3100 (each, product name of DuPont). Of these, a fluorine-based surfactant having 6 as x, more specifically, Zonyl FS-3100 is preferred.

Next, the silicone-based surfactant will be described in detail. As the silicone-based surfactant, that having a hydrophilic siloxane (—Si—O—) unit having a polyether chain and a hydrophobic siloxane unit having no polyether chain is preferred. Some silicone-based surfactants have a main chain with a polyether chain bonded thereto and some ones have a side chain with a polyether chain bonded thereto. The structure of the polyether chain is represented by —O—$(C_2H_4O)_a$—$(C_3H_6O)_b$—R, in which a stands for an integer of 1 or more, b stands for an integer of 0 or more, R represents a hydrogen atom or an alkyl group having 1 or more to 20 or less carbon atoms, $C_2H_4O$ is an ethylene oxide group and $C_3H_6O$ is a propylene oxide group. In a polyether-modified siloxane compound, ethylene oxide units and propylene oxide units may be present in any form in the structure of the compound, for example, at random or in block. Presence of these units at random means irregular arrangement of ethylene oxide units and propylene oxide units. Presence of these units in block means regular arrangement of blocks each comprised of some of the above-described units. Examples of the silicone-based surfactant include BYK-349, BYK-333 and BYK-3455 (each, product name of BYK). Of these, a silicone-based surfactant having a side chain with a polyether chain bonded thereto, more specifically, BYK-349 is preferred.

(Other Components)

As the other components, those similar to the aqueous medium and the other additive described later as usable in the first ink may be used.

<First Ink>

Components constituting the first ink to be used in the invention will next be described in detail.

(Coloring Material)

As the coloring material, pigments or dyes can be used. The content of the coloring material in the ink is preferably 0.5 mass % or more to 15.0 mass % or less based on the total mass of the ink, with 1.0 mass % or more to 10.0 mass % or less being more preferred.

Specific examples of the pigment include inorganic pigments such as carbon black and titanium oxide and organic pigments such as azo, phthalocyanine, quinacridone, isoindolinone, imidazolone, diketopyrrolopyrrole and dioxazine.

As the pigment, when classified by a dispersing method, a resin-dispersible pigment using a resin as a dispersant or a self-dispersible pigment having a hydrophilic group-bonded particle surface can be used. As well, a resin bonded pigment obtained by chemically bonding a resin-containing organic group to the particle surface of the pigment or a microcapsule pigment having a particle surface coated with a resin or the like can be used.

The resin dispersant for dispersing a pigment in an aqueous medium is preferably that capable of dispersing a pigment in an aqueous medium by the action of its anionic group. As the resin dispersant, resins described later can be used preferably, with water-soluble resins being more preferred. A mass ratio of the content (mass %) of the pigment to the content of the resin dispersant (pigment/resin dispersant) is preferably 0.3 times or more to 10.0 times or less.

As the self-dispersible pigment, usable are those having an anionic group such as carboxylic acid group, sulfonic acid group or phosphonic acid group bonded to the surface of pigment particles directly or via another atomic group (—R—). The anionic group may be present in either of an acid or salt form. In the latter case, either a portion or the whole of the salt may be dissociated. Examples of a cation which is the counter ion of the anionic group in salt form include alkali metal cations, ammonium and organic ammoniums. Specific examples of the another atomic group (—R—) include linear or branched alkylene groups having 1 to 12 carbon atoms, arylene groups such as phenylene and naphthylene, carbonyl groups, imino groups, amide groups, sulfonyl groups, ester groups and ether groups. As another atomic group, these groups may be used in combination.

As the dye, those having an anionic group are preferably used. Specific examples of the dye include azo, triphenylmethane, (aza)phthalocyanine, xanthene and anthrapyridone.

Of these, the coloring material is preferably the pigment, more preferably the resin-dispersible pigment.

(Resin)

A resin can be incorporated in the ink. The content (mass %) of the resin in the ink is preferably 0.1 mass % or more to 20.0 mass % or less based on the total mass of the ink, with 0.5 mass % or more to 15.0 mass % or less being more preferred.

The resin can be added to the ink for the purpose of (i) stabilizing the dispersion state of the pigment, that is, serving as the above-described resin dispersant or an auxiliary agent thereof, (ii) improving various properties of an image to be recorded, and the like. Examples of the form of the resin include block copolymers, random copolymers and graft copolymers, and combinations thereof. The resin may be dissolved as a water-soluble resin in an aqueous medium or dispersed as resin particles in an aqueous medium. The resin particles do not necessarily embrace the coloring material therein.

In the invention, when the resin is water soluble, it means that by neutralization of the resin with an alkali equivalent to the acid value of the resin, the resin does not form particles whose particle size can be measured by a dynamic light scattering method. Whether the resin is water soluble or not can be determined by the following method. First, a liquid containing a resin (resin solid content: 10 mass %) neutralized with an alkali (sodium hydroxide, potassium hydroxide, or the like) equivalent to an acid value is prepared. Then, the liquid thus prepared is diluted to 10 times (based on volume) with pure water to prepare a sample solution. The particle size of the resin in the sample solution is measured by the dynamic light scattering method. If particles with a particle size are not measured, the resin can be determined as water soluble. The measurement conditions at this time can be set, for example, as follows: SetZero: 30 seconds, measurement times: 3, and measurement time: 180 seconds. As a particle size distribution analyzers, a dynamic light scattering particle size analyzer (for example, "UPA-EX150"; product name of NIKKISO) can be used. It is needless to say that the particle size distribution analyzer and measurement conditions are not always limited to the above-described ones.

The resin, when it is water soluble, has preferably an acid value of 100 mgKOH/g or more to 250 mgKOH/g or less, while resin particles have preferably an acid value of 5 mgKOH/g or more to 100 mgKOH/g or less. The weight average molecular weight of the resin, when it is water soluble, is preferably 3,000 or more to 15,000 or less, while that of resin particles is preferably 1,000 or more to 2,000,000 or less. The volume-based cumulative particle size at 50% of the resin particles as measured by the dynamic light scattering method (under measurement conditions similar to those described above) is preferably 100 nm or more to 500 nm or less.

Examples of the resin include acrylic resins, urethane resins and olefin resins. Of these, acrylic resins and urethane resins are preferred.

Acrylic resins have preferably a hydrophilic unit and a hydrophobic unit as a constitution unit. Of these, acrylic resins having a hydrophilic unit derived from (meth)acrylic acid and a hydrophobic unit derived from at least one of an aromatic ring-containing monomer and a (meth)acrylate-based monomer are preferred. Particularly preferred are resins having a hydrophilic unit derived from (meth)acrylic acid and a hydrophobic unit derived from at least one of styrene and α-methylstyrene monomers. These resins easily cause interaction with the pigment so that they can preferably be used as a resin dispersant for dispersing the pigment.

The hydrophilic unit is a unit having a hydrophilic group such as anionic group. The hydrophilic unit can be formed, for example, by polymerizing a hydrophilic monomer having a hydrophilic group. Specific examples of the hydrophilic monomer having a hydrophilic group include acidic monomers having a carboxylic acid group such as (meth) acrylic acid, itaconic acid, maleic acid or fumaric acid and anionic monomers such as anhydrides or salts of these acidic monomers. Examples of a cation constituting the salt of the acidic monomer include ions such as lithium, sodium, potassium, ammonium, and organic ammonium. The hydrophobic unit does not have a hydrophilic group such as anionic group. The hydrophobic unit can be obtained by polymerizing a hydrophobic monomer having no hydrophilic group such as anionic group. Specific examples of the hydrophobic monomer include aromatic ring-containing monomers such as styrene, α-methylstyrene and benzyl (meth)acrylate and (meth)acrylate-based monomers such as methyl (meth)acrylate, butyl (meth)acrylate and 2-ethylhexyl (meth)acrylate.

The urethane resin can be obtained, for example, by reacting a polyisocyanate with a polyol. It may be obtained by reacting, in addition to them, with a chain extending agent. Examples of the olefin resins include polyethylene and polypropylene.

(Aqueous Medium)

The ink may contain water or an aqueous medium which is a mixed solvent of water and a water soluble organic solvent. The water is preferably deionized water or ion exchanged water. The content (mass %) of the water in the water-based ink is preferably 50.0 mass % or more to 95.0 mass % or less based on the total mass of the ink. The content (mass %) of the water-soluble organic solvent in the water-based ink is preferably 3.0 mass % or more to 50.0 mass % or less based on the total mass of the ink. As the water-soluble organic solvent, any of those usable for ink jet inks such as alcohols, (poly)alkylene glycols, glycol ethers, nitrogen-containing compounds, and sulfur-containing compounds can be used.

(Other Additives)

The ink may contain, in addition to the above-described components, various additives such as antifoam agent, surfactant, pH adjuster, viscosity modifier, rust inhibitor, antiseptic agent, mildew proofing agent, antioxidant and reduction preventive as needed.

EXAMPLES

The invention will hereinafter be described in further detail by Examples and Comparative Examples. The invention is not limited by the following Examples insofar as it does not depart from the gist of the invention. With respect to the amount of components, all designations of "part or parts" and "%" are on a mass basis unless otherwise particularly indicated.

<Preparation of Liquid Containing Resin Particles>

(Liquid Containing Resin Particles 1 and 3 to 6)

A container equipped with a stirrer, a thermometer and a temperature controller was charged with 167 g of polyethylene oxide wax ("Hi-Wax 4202E", product name of Mitsui Chemicals), 167 g of polyoxyethylene cetyl ether ("NIKKOL BB-20", product name of Nikko Chemicals", 6 g of a 48% aqueous potassium hydroxide solution and 660 g of ion exchanged water. After increasing the temperature to 160° C. and stirring for 2 hours, the temperature was cooled to 40° C. By changing the stirring rate at the time of stirring, liquids containing resin particles (content of the resin particles: 16.7%) having volume-based cumulative particle sizes at 90% given in Table 1 were obtained, respectively.

(Liquid Containing Resin Particles 2)

A container equipped with a stirrer, a thermometer and a temperature controller was charged with 266 g of polyethylene oxide wax ("Hi-Wax 4202E", product name of Mitsui Chemicals), 66 g of polyoxyethylene cetyl ether ("NIKKOL BB-20", product name of Nikko Chemicals", 10 g of a 48% aqueous potassium hydroxide solution and 658 g of ion exchanged water. After increasing the temperature to 160° C. and stirring for 2 hours, the temperature was cooled to 40° C. A liquid containing resin particles (content of the resin particles: 26.6%) having a volume-based cumulative particle size at 90% given in Table 1 was obtained.

(Liquid Containing Resin Particles 7 or 8)

A container equipped with a stirrer, a thermometer and a temperature controller was charged with 300 g of polyethylene oxide wax ("Hi-Wax 4202E", product name of Mitsui Chemicals), 33 g of polyoxyethylene cetyl ether ("NIKKOL BB-20", product name of Nikko Chemicals", 11 g of a 48% aqueous potassium hydroxide solution and 658 g of ion exchanged water. After increasing the temperature to 160° C. and stirring for 2 hours, the temperature was cooled to 40° C. By changing the stirring rate at the time of stirring, liquids containing resin particles (content of the resin particles: 30.0%) having volume-based cumulative particle sizes at 90% given in Table 1 were obtained, respectively.

(Liquid Containing Resin Particles 9)

A container equipped with a stirrer, a thermometer and a temperature controller was charged with 167 g of polypropylene wax ("Hi-Wax NP0555A", product name of Mitsui Chemicals), 33 g of polyoxyethylene cetyl ether ("NIKKOL BB-20", product name of Nikko Chemicals", 15.5 g of a 48% aqueous potassium hydroxide solution and 650.5 g of ion exchanged water. After increasing the temperature to 160° C. and stirring for 2 hours, the temperature was cooled to 40° C. A liquid containing Resin particles 9 (content of the resin particles: 16.7%) having a volume-based cumulative particle size at 90% indicated in Table 1 was obtained.

(Liquid Containing Resin Particles 10)

A solution was prepared by mixing 0.3 part of potassium persulfate and 74.0 parts of ion exchanged water. Further, an emulsified product was prepared by mixing 23.0 parts of ethyl methacrylate, 2.3 parts of methoxypolyethylene glycol methacrylate ("BLEMMER PME1000", product name of NOF Corporation) and 0.4 part of a reactive surfactant ("AQUALON KH-05", product name of DKS). In a nitrogen atmosphere, the emulsified product thus obtained was added dropwise to the solution for one hour and a polymerization reaction was performed while stirring the resulting mixture at 80° C., followed by stirring for further two hours. After cooling to room temperature, ion exchanged water and an aqueous potassium hydroxide solution were added to obtain a liquid containing nonionic Resin particles 10 (resin content: 25.0%). Resin particles 10 were found to have a volume-based cumulative particle size at 90% of 0.03 μm or more to 0.30 μm or less.

(Liquid Containing Resin Particles 11)

A liquid containing Resin particles 11 (resin content: 30.0%) was obtained by adjusting the concentration of a commercially available aqueous dispersion containing urethane resin particles ("SUPERFLEX 500M", product name of DSK). Nonionic Resin particles 11 were found to have a volume-based cumulative particle size at 90% of 0.03 μm or more to 0.30 μm or less.

[Measurement of Volume-Based Cumulative Particle Size at 90% of Resin Particles]

The volume-based cumulative particle size at 90% of the resin particles is measured using, as a sample, a resin particle-containing liquid diluted with pure water to have a resin particle content of 1.0% by means of a dynamic light scattering system particle size distribution analyzer ("Nanotrac UPA150EX"; product name of NIKKISO). Measurement conditions are as follows: SetZero: 30 seconds, measurement times: 3, measurement time: 180 seconds, shape: true sphere and refractive index: 1.6.

TABLE 1

| Volume-based cumulative particle size at 90% ($D_{90}$) of resin particles | |
|---|---|
| | $D_{90}$(μm) |
| Resin particles 1 | 0.04 |
| Resin particles 2 | 0.20 |
| Resin particles 3 | 0.10 |
| Resin particles 4 | 0.09 |
| Resin particles 5 | 0.01 |
| Resin particles 6 | 0.03 |
| Resin particles 7 | 0.30 |
| Resin particles 8 | 0.40 |
| Resin particles 9 | 0.04 |

<Preparation of Reaction Liquid>

Components (unit: %) given in Table 2 were mixed, followed by sufficient stirring. Then, the reaction mixture was pressure filtered through Micro Filter having a pore size of 3.0 μm (product name of Fujifilm) to prepare a reaction liquid. Zonyl FS-3100 is a nonionic fluorine-based surfactant produced by DuPont. BYK-349 is a silicone-based nonionic surfactant produced by BYK. The content (%) of the resin particles in the reaction liquid is given in the bottom column of Table 2.

<Preparation of Pigment Dispersion>

A styrene-ethyl acrylate-acrylic acid copolymer (resin dispersant) having an acid value of 150 mgKOH/g and a weight average molecular weight of 8,000 was prepared. The resulting copolymer (20.0 parts) was neutralized with potassium hydroxide in an amount equimolar to the acid value of the copolymer and an adequate amount of pure water was added to prepare an aqueous solution of the resin dispersant having a resin content (solid content) of 20.0%. Then, 10.0 parts of a pigment ("MONARCH 1100", product name of Cabot Corporation), 15.0 parts of the aqueous solution of the resin dispersant and 75.0 parts of pure water were mixed. The resulting mixture and 200 parts of zirconia beads having a diameter of 0.3 mm were charged in a batch type vertical sand mill (product name of Aimex) and the mixture was dispersed for 5 hours while cooling with water. Then, crude particles were removed by centrifugal separation, followed by pressure filtration through a cellulose acetate filter having a pore size of 3.0 μm (product name of Advantec) to prepare a pigment dispersion having a pigment content of 10.0% and a resin dispersant content of 3.0%.

<Preparation of Liquid Containing Resin Particles 12>

Ethyl methacrylate (18.0 parts), 3.0 parts of 2,2-azobis-(2-methylbutyronitrile) and 2.0 parts of n-hexadecane were mixed, followed by stirring for 30 minutes. The resulting mixture was added dropwise to 75.0 parts of a 8% aqueous solution of a styrene-butyl acrylate-acrylic acid copolymer having an acid value of 130 mgKOH/g and a weight average molecular weight of 7,000 and the resulting mixture was stirred for 24 minutes. Then, the reaction mixture was

TABLE 2

| Composition and property of reaction liquid | | | | | | | | | | | | | | | | | | |
|---|---|---|---|---|---|---|---|---|---|---|---|---|---|---|---|---|---|---|
| | No. of reaction liquid | | | | | | | | | | | | | | | | | |
| | 1 | 2 | 3 | 4 | 5 | 6 | 7 | 8 | 9 | 10 | 11 | 12 | 13 | 14 | 15 | 16 | 17 | 18 |
| Malic acid | 35.0 | 35.0 | | | 35.0 | 35.0 | 35.0 | 35.0 | 35.0 | 35.0 | 20.0 | 35.0 | 35.0 | 35.0 | 35.0 | 35.0 | 35.0 | 35.0 |
| Citric acid | | | 35.0 | | | | | | | | | | | | | | | |
| Malonic acid | | | | 35.0 | | | | | | | | | | | | | | |
| Potassium hydroxide | 1.0 | 1.0 | 1.0 | 1.0 | 1.0 | 1.0 | 1.0 | 1.0 | 1.0 | 1.0 | 0.5 | 1.0 | 1.0 | 1.0 | 1.0 | 1.0 | 1.0 | 1.0 |
| 2-Pyrrolidone | 5.0 | 5.0 | 5.0 | 5.0 | 5.0 | 5.0 | 5.0 | 5.0 | 5.0 | 5.0 | 2.5 | 5.0 | 5.0 | 5.0 | 5.0 | 5.0 | 5.0 | 5.0 |
| Zonyl FS-3100 | 3.0 | | 3.0 | 3.0 | 3.0 | 3.0 | 3.0 | 3.0 | 3.0 | 3.0 | 1.0 | 3.0 | 3.0 | 3.0 | 3.0 | 3.0 | 3.0 | 3.0 |
| BYK-349 | | 3.0 | | | | | | | | | | | | | | | | |
| Liquid containing Resin particles 1 | 50.0 | 50.0 | 50.0 | 50.0 | | | | | | | 25.0 | 25.0 | 56.0 | | | | | |
| Liquid containing Resin particles 2 | | | | | | | | | | | | | | | | | | 31.6 |
| Liquid containing Resin particles 3 | | | | | | 50.0 | | | | | | | | | | | | |
| Liquid containing Resin particles 4 | | | | | 50.0 | | | | | | | | | | | | | |
| Liquid containing Resin particles 5 | | | | | | | 50.0 | | | | | | | | | | | |
| Liquid containing Resin particles 6 | | | | | | | | 50.0 | | | | | | | | | | |
| Liquid containing Resin particles 7 | | | | | | | | | 28.0 | | | | | | | | | |
| Liquid containing Resin particles 8 | | | | | | | | | | 28.0 | | | | | | | | |
| Liquid containing Resin particles 9 | | | | | | | | | | | | | | 50.0 | | | | |
| Liquid containing Resin particles 10 | | | | | | | | | | | | | | | 33.6 | | | |
| Liquid containing Resin particles 11 | | | | | | | | | | | | | | | | 28.0 | | |
| Ion exchanged water | 6.0 | 6.0 | 6.0 | 6.0 | 6.0 | 6.0 | 6.0 | 6.0 | 28.0 | 28.0 | 51.0 | 31.0 | 0.0 | 6.0 | 22.4 | 28.0 | 56.0 | 24.4 |
| Content (%) of resin particles in reaction liquid | 8.4 | 8.4 | 8.4 | 8.4 | 8.4 | 8.4 | 8.4 | 8.4 | 8.4 | 8.4 | 4.2 | 4.2 | 9.4 | 8.4 | 8.4 | 8.4 | 0.0 | 8.4 |

exposed to ultrasonic waves for 3 hours by using an ultrasonic irradiation apparatus and a polymerization reaction was performed at 80° C. for 4 hours in a nitrogen atmosphere. The temperature was cooled to 25° C. and then the polymerization product was filtered to obtain a liquid containing Resin particles 12 (resin particle content: 25.0%).

<Preparation of First Ink>

After mixing the components (unit: %) given in Table 3 and sufficient stirring, the reaction mixture was pressure filtered through Micro Filter having a pore size of 3.0 μm (product name of Fujifilm) to obtain a first ink. Acetylenol E100 is a nonionic surfactant produced by Kawaken Fine Chemicals. The content (%) of the pigment in the first ink is given in the bottom column of Table 3.

TABLE 3

Composition and property of first ink

| | No. of first ink | |
|---|---|---|
| | 1 | 2 |
| Pigment dispersion | 40.0 | |
| Liquid containing Resin particles 12 | 20.0 | 20.0 |
| Glycerin | 7.0 | 7.0 |
| ACETYLENOL E100 | 0.5 | 0.5 |
| Ion exchanged water | 32.5 | 72.5 |
| Content (%) of pigment in first ink | 4.0 | 0.0 |

<Manufacture of Porous Body of Liquid Absorption Member>

(Liquid Absorption Members 1 to 6)

As a first layer, a fibrillated porous layer was prepared by performing compression molding of emulsion polymerization particles of a crystallized fluorine-based resin (polytetrafluoroethylene) and stretching the molded product at a temperature not greater than the melting point. By changing the stretching rate and temperature, porous layers as the first layer having volume-based cumulative pore sizes at 10% of the values given in Table 4 were obtained, respectively.

As a second layer, a polyolefin-based nonwoven fabric HOP60 (product name of Hirose Paper MFG Co.) was used. The first layers and the second layer were thermally bonded to obtain porous bodies, respectively.

(Liquid Absorption Member 7)

As a first layer, a fibrillated porous layer was prepared by compression molding of emulsion polymerization particles of a crystallized fluorine-based resin (polyvinylidene fluoride) and stretching the molded product at the melting point or less. The volume-based cumulative pore size at 10% of the porous layer was a value given in Table 4.

As a second layer, a polyolefin-based nonwoven fabric HOP60 (product name of Hirose Paper MFG Co.) was used. The first layer and the second layer were thermally bonded to obtain a porous body.

(Liquid Absorption Member 8)

As a first layer, a fibrillated porous layer was prepared by performing compression molding of emulsion polymerization particles of a crystallized olefin resin (polypropylene) and stretching the molded product at the melting point or less. The volume-based cumulative pore size at 10% of the resulting porous layer was a value given in Table 4.

As a second layer, a polyolefin-based nonwoven fabric HOP60 (product name of Hirose Paper MFG Co.) was used. The first layer and the second layer were thermally bonded to obtain a porous body.

(Liquid Absorption Member 9)

As a first layer, a fibrillated porous layer was prepared by performing compression molding of emulsion polymerization particles of a crystallized polyester resin (polyethylene terephthalate) and stretching the molded product at the melting point or less. The volume-based cumulative pore size at 10% of the resulting porous layer was a value given in Table 4.

As a second layer, a polyolefin-based nonwoven fabric HOP60 (product name of Hirose Paper MFG Co.) was used. The first layer and the second layer were thermally bonded to obtain a porous body.

[Method of Measuring Volume-Based Cumulative Pore Size at 10% of Porous Layer]

The volume-based cumulative pore size at 10% of the porous layer was measured using a pore size distributionanalyzer using a gas permeation method ("POROMETER 3 Gz", product name of Quantachrome Instruments).

TABLE 4

Volume-based cumulative pore size at 10% (D10) of porous layer possessed by liquid absorption member

| | $D_{10}$ (μm) |
|---|---|
| Liquid absorption member 1 | 0.20 |
| Liquid absorption member 2 | 0.05 |
| Liquid absorption member 3 | 0.10 |
| Liquid absorption member 4 | 0.50 |
| Liquid absorption member 5 | 1.00 |
| Liquid absorption member 6 | 2.00 |
| Liquid absorption member 7 | 0.20 |
| Liquid absorption member 8 | 0.20 |
| Liquid absorption member 9 | 0.20 |

<Evaluation>

In the invention, AA, A or B is an acceptable level and C is an unacceptable level in the following evaluation criteria. Combination of the reaction liquid, the first ink and the liquid absorption member to be used in each of Examples, Comparative Examples and Referential Examples, evaluation conditions and evaluation results are given in Tables 5 and 6. In Tables 5 and 6, the volume-based cumulative particle size at 90% of the resin particles and the volume-based cumulative pore size at 10% of the porous layer are expressed by $D_{90}$ (μm) and $D_{10}$ (μm), respectively. Further, a ratio of the volume-based cumulative pore size at 10% of the porous body to the volume-based cumulative particle size at 90% of the resin particles is expressed by $D_{10}/D_{90}$.

Examples 1 to 25, Comparative Examples 1 to 3 and Referential Examples 1 and 2

By using the transfer type ink jet recording apparatus shown in FIG. 1, an image was recorded. As the support member 102, a cylindrical drum made of aluminum was used. As the member of the surface layer of the transfer body 101, a 0.5-mm thick PET sheet coated with a 0.2-mm thick silicone rubber ("KE12", product name of Shin-Etsu Chemical) having a rubber hardness (Durometer Type A) of 40° was used. Plasma surface treatment was given to the surface by means of an atmospheric pressure plasma treatment apparatus ("ST-7000", product name of KEYENCE CORPORATION) under the following conditions: treatment distance: 5 mm, plasma mode: High and treatment rate: 100 mm/sec. Further, the resulting surface was immersed for 10 seconds in a solution obtained by diluting a commercially available neutral detergent containing a sodium alkylbenzenesulfonate with pure water to give its concentration of 3%. Then, the surface was dried to obtain a member of the surface layer of the transfer body 101. The transfer body 101 thus obtained was fixed to the support member 102 with a double-sided adhesive tape.

The reaction liquid was loaded in the reaction liquid applying unit 103 and 1.0 g/m$^2$ of it was applied to the transfer body 101. The first ink was loaded in the ink applying unit 104 and by the thermal energy given to the ink, it was ejected to the transfer body 101 through an on demand system. The transfer body had a portion to which the ink was not applied, though the reaction liquid was applied to the transfer body.

As the porous body to be used for the liquid absorption member 105*a*, that manufactured above was used. The conveyance speed of the conveyance roller 105*c* for conveying the liquid absorption member was adjusted to be equal to the moving speed of the transfer body 101. The conveyance speed of the conveyance roller 105*c* was 0.4 m/s. Further, the liquid absorption member 105*a* was immersed in a treatment liquid containing 95.0 parts of ethanol and 5.0 parts of water to impregnate the voids of the porous body with the liquid. Then, the liquid was replaced by water. A pressure was applied to the pressing member 105*b* to give an average nip pressure, between the transfer body 101 and the liquid absorption member 105*a*, of 2 kg/cm$^2$.

Then, the recording medium 108 was conveyed using the recording medium delivery roller 107*a* and the recording medium winding roller 107*b* so as to make the conveyance speed equal to the moving speed of the transfer body 101 and the recording medium 108 was brought into contact with the first image between the transfer body 101 and the pressing member 106. The first image was thus transferred from the transfer body 101 to the recording medium 108. As the recording medium 108, coated paper (Aurora Coat coated paper, product name of Nippon Paper Industries) was used. In the present Examples, the nip pressure between the transfer body 101 and the pressuring member 106 was adjusted to 3 kg/cm$^2$.

Examples 26 to 50 and Comparative Examples 4 to 6

An image was recorded using the direct recording type ink jet recording apparatus shown in FIG. 2. The reaction liquid applying unit 203, the ink applying unit 204, the conveyance speed of the recording medium and the liquid absorption unit 205 were operated under conditions similar to those of the transfer type ink jet recording apparatus. As the recording medium 208, cast-coat paper (Gloria pure white paper, product name of Gojou Paper Mfg) was used.

[Movement of Coloring Material]

When the transfer type ink jet recording apparatus was used, a first image having a first ink recording duty of 200% was formed on the transfer body and then it was transferred to Aurora Coat coated paper to record an image (5 cm×5 cm solid image). When the direct recording type ink jet recording apparatus was used, on the other hand, an image (5 cm×5 cm solid image) having a first ink recording duty of 200% was recorded on Gloria pure white paper. In the present Examples, an image recorded under the conditions of applying 3.0 ng of ink droplets to a unit region of 1/1,200 inch×1/1,200 inch at a resolution of 1,200 dpi×1,200 dpi is defined as an image having a recording duty of 100%. The movement of the coloring material to the first image of the porous layer by the contact therewith was evaluated by recording a predetermined number of images and visually observing whether the coloring material moves to a direction around the image or not. The movement of the coloring material was evaluated based on the following evaluation criteria.

A: Movement of the coloring material was not observed even at the time of recording an image on 30 sheets of paper.

B: Movement of the coloring material was observed at the time of recording an image on 30 sheets of paper.

C: Movement of the coloring material was observed at the time of recording an image on 10 sheets of paper.

[Coloring Material Adhesion to Porous Layer]

When the transfer type ink jet recording apparatus was used, a first image having a recording duty of the first ink of 200% was formed on the transfer body and it was transferred to Aurora Coat coated paper to record an image (5 cm×5 cm solid image). When the direct recording type ink jet recording apparatus was used, an image (5 cm×5 cm solid image) having a first ink recording duty of 200% was recorded on Gloria pure white paper. After recording an image on a predetermined number of sheets of paper, adhesion of the coloring material to the porous layer possessed by the liquid absorption member 105*a* was observed. The adhesion of the coloring material to the porous layer was evaluated based on the following evaluation criteria.

A: Adhesion of the coloring material was not observed even at the time of recording an image on 30 sheets of paper.

B: Adhesion of the coloring material was observed at the time of recording an image on 30 sheets of paper.

C: Adhesion of the coloring material was observed at the time of recording an image on 10 sheets of paper.

[Density Unevenness of Image]

When the transfer type ink jet recording apparatus was used, a first image having a first ink recording duty of 100% was formed on the transfer body and it was then transferred to Aurora Coat coated paper to record an image (5 cm×5 cm solid image). When the direct recording type ink jet recording apparatus was used, an image (5 cm×5 cm solid image) having a first ink recording duty of 100% was recorded on Gloria pure white paper. Setting the first ink recording duty at 100% facilitates observation of the density unevenness of the image even when the image is observed visually.

AA: No density unevenness of the image was observed.

A: Density unevenness of the image was observed and the image was partially pale.

B: Density unevenness of the image was observed and the image had a colorless portion.

TABLE 5

Evaluation conditions and evaluation results

| | Evaluation conditions | | | | | | Evaluation results | | |
|---|---|---|---|---|---|---|---|---|---|
| | Kind of reaction liquid | Kind of first ink | Kind of liquid absorption member | $D_{90}$ (mm) | $D_{10}$ (μm) | $D_{10}/D_{90}$ (ratio) | Transfer of coloring material | Adhesion of coloring material to porous layer | Density unevenness of image |
| Example 1 | 1 | 1 | 1 | 0.04 | 0.20 | 5.0 | A | A | AA |
| Example 2 | 2 | 1 | 1 | 0.04 | 0.20 | 5.0 | A | A | AA |
| Example 3 | 3 | 1 | 1 | 0.04 | 0.20 | 5.0 | A | A | AA |
| Example 4 | 4 | 1 | 1 | 0.04 | 0.20 | 5.0 | A | A | AA |

TABLE 5-continued

| Evaluation conditions and evaluation results | | | | | | | | | |
|---|---|---|---|---|---|---|---|---|---|
| | Evaluation conditions | | | | | | Evaluation results | | |
| | Kind of reaction liquid | Kind of first ink | Kind of liquid absorption member | $D_{90}$ (mm) | $D_{10}$ (μm) | $D_{10}/D_{90}$ (ratio) | Transfer of coloring material | Adhesion of coloring material to porous layer | Density unevenness of image |
| Example 5 | 5 | 1 | 3 | 0.09 | 0.10 | 1.1 | B | B | A |
| Example 6 | 6 | 1 | 1 | 0.10 | 0.20 | 2.0 | B | B | A |
| Example 7 | 5 | 1 | 1 | 0.09 | 0.20 | 2.2 | A | A | AA |
| Example 8 | 1 | 1 | 2 | 0.04 | 0.05 | 1.3 | B | B | A |
| Example 9 | 1 | 1 | 3 | 0.04 | 0.10 | 2.5 | A | A | AA |
| Example 10 | 1 | 1 | 4 | 0.04 | 0.50 | 12.5 | A | A | AA |
| Example 11 | 1 | 1 | 5 | 0.04 | 1.00 | 25.0 | A | A | AA |
| Example 12 | 1 | 1 | 6 | 0.04 | 2.00 | 50.0 | B | B | A |
| Example 13 | 7 | 1 | 1 | 0.01 | 0.20 | 20.0 | B | A | AA |
| Example 14 | 8 | 1 | 1 | 0.03 | 0.20 | 6.7 | A | A | AA |
| Example 15 | 9 | 1 | 5 | 0.30 | 1.00 | 3.3 | A | A | AA |
| Example 16 | 10 | 1 | 5 | 0.40 | 1.00 | 2.5 | A | A | B |
| Example 17 | 1 | 1 | 7 | 0.04 | 0.20 | 5.0 | A | A | AA |
| Example 18 | 1 | 1 | 8 | 0.04 | 0.20 | 5.0 | A | B | A |
| Example 19 | 1 | 1 | 9 | 0.04 | 0.20 | 5.0 | A | B | A |
| Example 20 | 11 | 1 | 1 | 0.04 | 0.20 | 5.0 | A | A | A |
| Example 21 | 12 | 1 | 1 | 0.04 | 0.20 | 5.0 | A | A | AA |
| Example 22 | 13 | 1 | 1 | 0.04 | 0.20 | 5.0 | A | A | AA |
| Example 23 | 14 | 1 | 1 | 0.04 | 0.20 | 5.0 | A | A | AA |
| Example 24 | 15 | 1 | 5 | — | 1.00 | ≥3.3 | A | A | AA |
| Example 25 | 16 | 1 | 5 | — | 1.00 | ≥3.3 | A | A | AA |
| Example 26 | 1 | 1 | 1 | 0.04 | 0.20 | 5.0 | A | A | AA |
| Example 27 | 2 | 1 | 1 | 0.04 | 0.20 | 5.0 | A | A | AA |
| Example 28 | 3 | 1 | 1 | 0.04 | 0.20 | 5.0 | A | A | AA |
| Example 29 | 4 | 1 | 1 | 0.04 | 0.20 | 5.0 | A | A | AA |

TABLE 6

| Evaluation conditions and evaluation results | | | | | | | | | |
|---|---|---|---|---|---|---|---|---|---|
| | Evaluation conditions | | | | | | Evaluation results | | |
| | Kind of reaction liquid | Kind of first ink | Kind of liquid absorption member | $D_{90}$ (μm) | $D_{10}$ (μm) | $D_{10}/D_{90}$ (ratio) | Transfer of coloring material | Adhesion of coloring material to porous layer | Density unevenness of image |
| Example 30 | 5 | 1 | 3 | 0.09 | 0.10 | 1.1 | B | B | A |
| Example 31 | 6 | 1 | 1 | 0.10 | 0.20 | 2.0 | B | B | A |
| Example 32 | 5 | 1 | 1 | 0.09 | 0.20 | 2.2 | A | A | AA |
| Example 33 | 1 | 1 | 2 | 0.04 | 0.05 | 1.3 | B | B | A |
| Example 34 | 1 | 1 | 3 | 0.04 | 0.10 | 2.5 | A | A | AA |
| Example 35 | 1 | 1 | 4 | 0.04 | 0.50 | 12.5 | A | A | AA |
| Example 36 | 1 | 1 | 5 | 0.04 | 1.00 | 25.0 | A | A | AA |
| Example 37 | 1 | 1 | 6 | 0.04 | 2.00 | 50.0 | B | B | A |
| Example 38 | 7 | 1 | 1 | 0.01 | 0.20 | 20.0 | B | A | AA |
| Example 39 | 8 | 1 | 1 | 0.03 | 0.20 | 6.7 | A | A | AA |
| Example 40 | 9 | 1 | 5 | 0.30 | 1.00 | 3.3 | A | A | AA |
| Example 41 | 10 | 1 | 5 | 0.40 | 1.00 | 2.5 | A | A | B |
| Example 42 | 1 | 1 | 7 | 0.04 | 0.20 | 5.0 | A | A | AA |
| Example 43 | 1 | 1 | 8 | 0.04 | 0.20 | 5.0 | A | B | A |
| Example 44 | 1 | 1 | 9 | 0.04 | 0.20 | 5.0 | A | B | A |
| Example 45 | 11 | 1 | 1 | 0.04 | 0.20 | 5.0 | A | A | A |
| Example 46 | 12 | 1 | 1 | 0.04 | 0.20 | 5.0 | A | A | AA |
| Example 47 | 13 | 1 | 1 | 0.04 | 0.20 | 5.0 | A | A | AA |
| Example 48 | 14 | 1 | 1 | 0.04 | 0.20 | 5.0 | A | A | AA |
| Example 49 | 15 | 1 | 5 | — | 1.00 | ≥3.3 | A | A | AA |
| Example 50 | 16 | 1 | 5 | — | 1.00 | ≥3.3 | A | A | AA |
| Comp. Ex. 1 | 17 | 1 | 1 | — | 0.20 | — | C | A | A |
| Comp. Ex. 2 | 9 | 1 | 1 | 0.30 | 0.20 | 0.7 | C | C | B |
| Comp. Ex. 3 | 18 | 1 | 1 | 0.20 | 0.20 | 1.0 | C | C | B |
| Comp. Ex. 4 | 17 | 1 | 1 | — | 0.20 | — | C | A | A |
| Comp. Ex. 5 | 9 | 1 | 1 | 0.30 | 0.20 | 0.7 | C | C | B |
| Comp. Ex. 6 | 18 | 1 | 1 | 0.20 | 0.20 | 1.0 | C | C | B |
| Ref. Ex. 1 | 1 | 1 | — | 0.04 | — | 0.0 | A | A | AA |
| Ref. Ex. 2 | 1 | 2 | 1 | 0.04 | 0.20 | 5.0 | — | — | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131066, filed Jul. 4, 2017, and Japanese Patent Application No. 2018-111479, filed Jun. 11, 2018, which are hereby incorporated by reference herein in their entirety.

What is claimed is:

1. An ink jet recording method for recording an image using an aqueous reaction liquid and a water-based ink comprising a first ink, comprising:

a reaction liquid applying step for applying the aqueous reaction liquid comprising a reactant and resin particles to a first recording medium;

an image formation step for applying the first ink comprising a coloring material to the first recording medium to form a first image; and a liquid absorption step for bringing a porous layer of a liquid absorption member into contact with an area of the first recording medium that includes the first image to absorb a liquid component from the first image, wherein a volume-based cumulative pore size (μm) at 10% of the porous layer is greater than a volume-based cumulative particle size (μm) at 90% of the resin particles.

2. The ink jet recording method according to claim 1, wherein a ratio of the volume-based cumulative pore size (μm) at 10% of the porous layer to the volume-based cumulative particle size at 90% (μm) of the resin particles is 2.2 times or more.

3. The ink jet recording method according to claim 1, wherein the volume-based cumulative particle size (μm) at 10% of the porous layer is 0.10 μm to 1.00 μm.

4. The ink jet recording method according to claim 1, wherein the volume-based cumulative particle size (μm) at 90% of the resin particles is 0.03 μm to 0.30 μm.

5. The ink jet recording method according to claim 1, wherein the porous layer comprises a fluorine-based resin.

6. The ink jet recording method according to claim 1, wherein the reaction liquid is applied to the first recording medium with a roller.

7. The ink jet recording method according to claim 1, wherein the first recording medium is a transfer body; and wherein the ink jet recording method further comprises, after the liquid absorption step, a transfer step for transferring the first image of the first recording medium to a second recording medium.

8. The ink jet recording method according to claim 1, wherein the resin particles comprise polyolefin wax particles.

9. An ink jet recording apparatus comprising:

a unit configured to apply a reaction liquid to a first recording medium;

a unit configured to apply a first ink to the first recording medium, after application of the reaction liquid to the first recording medium, so that the first ink contacts the reaction liquid; and a unit including a liquid absorption member configured to bring a porous layer of the liquid absorption member into contact with an area of the first recording medium that includes a first image formed by the reaction liquid and the first ink, wherein the reaction liquid is an aqueous reaction liquid comprising a reactant and resin particles, wherein the first ink is a water-based ink comprising a coloring material; and wherein a volume-based cumulative pore size (μm) at 10% of the porous layer is greater than a volume-based cumulative particle size (μm) at 90% of the resin particles.

10. The ink jet recording method according to claim 1, wherein a content of the resin particles in the aqueous reaction liquid is 1.0 mass % to 25.0 mass %.

11. The ink jet recording method according to claim 1, wherein the aqueous reaction liquid further comprises a surfactant selected from the group consisting of a fluorine-based surfactant and a silicone-based surfactant.

* * * * *